US009222297B2

(12) United States Patent
Uehara et al.

(10) Patent No.: US 9,222,297 B2
(45) Date of Patent: Dec. 29, 2015

(54) OPENABLE ROOF WINDOW

(71) Applicant: Yachiyo Industry Co., Ltd., Sayama-shi, Saitarna (JP)

(72) Inventors: Tatsuaki Uehara, Tochigi-ken (JP); Ayumi Mihashi, Sakura (JP)

(73) Assignee: Yachiyo Industry, Co., Ltd., Sayama-shi, Saitama (JP)

( * ) Notice: Subject to any disclaimer, the term of this patent is extended or adjusted under 35 U.S.C. 154(b) by 184 days.

(21) Appl. No.: 13/927,596

(22) Filed: Jun. 26, 2013

(65) Prior Publication Data

US 2014/0000168 A1 Jan. 2, 2014

(30) Foreign Application Priority Data

Jun. 27, 2012 (JP) ..... 2012-144639

(51) Int. Cl.

*E06B 3/50* (2006.01)
*E04D 13/035* (2006.01)
*E05F 15/638* (2015.01)

(52) U.S. Cl.

CPC ..... *E06B 3/5054* (2013.01); *E04D 13/0357* (2013.01); *E05F 15/638* (2015.01); *E05Y 2201/638* (2013.01); *E05Y 2900/154* (2013.01)

(58) Field of Classification Search

IPC .. E06B 3/5063,3/5072, 3/5054; E04D 13/0357; B60J 7/02, 7/053, 7/0573

See application file for complete search history.

(56) References Cited

U.S. PATENT DOCUMENTS

| | | | | | |
|---|---|---|---|---|---|
| 4,364,601 | A * | 12/1982 | Katayama et al. | ..... | 296/221 |
| 5,795,016 | A * | 8/1998 | Otake | ..... | 296/223 |
| 2001/0008347 | A1 * | 7/2001 | Ito et al. | ..... | 296/221 |
| 2001/0026085 | A1 * | 10/2001 | Farmont et al. | ..... | 296/223 |
| 2007/0114817 | A1 * | 5/2007 | Becher et al. | ..... | 296/216.03 |
| 2009/0072589 | A1 * | 3/2009 | Ito et al. | ..... | 296/216.04 |
| 2011/0121615 | A1 * | 5/2011 | Chauvin et al. | ..... | 296/220.01 |
| 2012/0025568 | A1 * | 2/2012 | Faerber | ..... | 296/216.08 |
| 2013/0307293 | A1 * | 11/2013 | Kokubo et al. | ..... | 296/213 |

FOREIGN PATENT DOCUMENTS

| | | | |
|---|---|---|---|
| JP | 61-94115 U | | 6/1986 |
| JP | 62-034814 | * | 2/1987 |
| JP | 63-27656 A | | 2/1988 |

* cited by examiner

*Primary Examiner* — Gregory Strimbu
(74) *Attorney, Agent, or Firm* — Dority & Manning, P.A.

(57) ABSTRACT

An openable roof window includes: a window panel configured to be slidable along a guide rail to selectively open and close an opening in a roof and tiltable relative to a base frame; a slider having a pin and driven by a drive device to slide along the guide rail; an engagement structure that selectively engages the slider with the window panel such that they are unmovable relative to each other in a direction along the guide rail; and the engagement structure includes a stay fixedly secured to the window panel and having a cam groove formed therein, the cam groove engaging the pin of the slider and having a shape defined such that, when the engagement structure does not engage the slider with the window panel, the window panel is caused to tilt as the slider moves relative to the stay as a result of sliding of the slider along the guide rail.

5 Claims, 15 Drawing Sheets

OPENABLE ROOF WINDOW

CROSS-REFERENCE TO RELATED APPLICATIONS

This application claims the priority of Japanese Patent Application No. 2012-144639, filed in the Japanese Patent Office on Jun. 27, 2012, the disclosure of which is hereby incorporated by reference herein in its entirety for all purposes.

TECHNICAL FIELD

The present invention relates to an openable roof window configured to be mounted on the roof of a building.

BACKGROUND OF THE INVENTION

Some houses are provided with a roof window (may also be referred to as a skylight) for admitting sunlight. Many roof windows are of the type that cannot be opened and closed since they are often installed at locations that cannot be easily accessed. However, some roof windows are designed to be openable for ventilation, for example. Such an openable roof window may be opened and closed manually or may be driven electrically by an electric drive device in response to an operation performed by a user on an operation unit connected to the drive device wirelessly or by wire.

A variety of mechanisms for opening and closing a roof window have been proposed. For example, JP 63-27656A discloses an openable roof window including a base frame mounted to an opening formed in a roof, a movable window panel that is movable relative to the base frame to open and close the opening, and a pair of links rotatably connected to each other at intermediate portions thereof generally in a shape of a letter "X" and each having one end pivotably connected to one of the base frame and the movable window panel and the other end slidably received in a guide groove formed in the other of the base frame and the movable window panel, such that the base frame and the movable window panel are connected to each other via the pair of links. The distance from the one end of each link to the rotation axis is different from the distance from the rotation axis to the other end, whereby when the movable window panel is moved away from the base frame to open the opening, the movable window panel is tilted relative to the base frame.

Further, JP 61-94115 U discloses an openable roof window including a base frame mounted to an opening formed in a roof and a movable window panel having one end portion pivotably connected to the base frame, where the openable roof window is configured to prevent the movable window panel from being blown open by a strong wind beyond a desirable range, so that damage to the window panel caused by a strong wind can be avoided. The openable roof window disclosed in JP 61-94115 U includes a gas spring which connects the movable window panel to the base frame and prevents abrupt opening of the movable window panel. Specifically, one end of the gas spring is pivotably connected to one of the movable window panel and the base frame and the other end of the gas spring is pivotably connected to the other of the movable window panel and the base frame. The openable roof window disclosed in JP 61-94115 U further includes a rod member having one end portion pivotably connected to the movable window panel and the other end portion having an elongated hole formed therein to slidably receive a pin provided to the base frame, whereby the rod member limits the angular range of the pivoting movement of the movable window panel relative to the base frame in the opening direction.

However, in the conventional openable roof windows, the support stiffness of the movable window panel is not sufficient when the roof window is open. Specifically, in the openable roof window disclosed in JP 63-27656A, the movable window panel is supported only by the pair of links each consisting of an elongated rod member connected to the base frame and the movable window panel at the end portions thereof pivotably or slidably, and therefore, it is difficult to achieve sufficient support stiffness of the movable window panel. In the openable roof window disclosed in JP 61-94115 U, the movable window panel in the open state is supported by the gas spring and the rod member, each of which is pivotably connected to the movable window panel, and thus, the support stiffness of the movable window panel is low. Further, the opening and closing mechanisms disclosed in the foregoing prior art documents do not contribute to increase in the strength of the movable window panel. Moreover, the openable roof windows disclosed in these prior art documents are not configured to allow the movable window panel to slide relative to the base frame.

SUMMARY OF THE INVENTION

In view of the aforementioned problems in the prior art, a primary object of the present invention is to provide an openable roof window including a movable window panel that is tiltable and slidable, such that the support stiffness and the strength of the movable window panel are improved.

According to an embodiment of the present invention, there is provided an openable roof window, including: a base frame defining an opening and configured to be secured to a roof; a guide rail mounted to the base frame; a movable window panel configured to be slidable along the guide rail in an opening direction to open the opening and in a closing direction to close the opening, the movable window panel further configured to be tiltable relative to the base frame; a first sliding member having a pin and configured to be driven by a drive device to slide along the guide rail; an engagement structure that selectively engages the first sliding member with the movable window panel such that the first sliding member and the movable window panel are unmovable relative to each other in a direction along the guide rail; and a stay fixedly secured to the movable window panel and having a cam groove formed therein, the cam groove engaging the pin of the first sliding member and having a shape defined such that, when the engagement structure does not engage the first sliding member with the movable window panel, the movable window panel is caused to tilt as the first sliding member moves relative to the stay as a result of sliding of the first sliding member along the guide rail.

According to the foregoing structure, the stay fixedly secured to the movable window panel effectively reinforces the movable window panel. Further, since the slider directly supports the stay secured to the movable window panel, the support stiffness of the movable window panel is improved.

In a preferred embodiment of the present invention, the openable roof window further includes a lock member configured to be placed at a lock position where the lock member prevents sliding of the movable window panel along the guide rail when the pin is at a position other than an end portion of the cam groove in the opening direction and to be placed at an unlock position where the lock member permits the sliding of the movable window panel along the guide rail when the pin is at the end portion of the cam groove in the opening direction, wherein the engagement structure engages the first sliding member with the movable window panel so as to be unmovable relative to each other in the direction along the guide rail when the lock member is at the unlock position, and allows the first sliding member to move relative to the movable window panel in the direction along the guide rail when the lock member is at the lock position. According to this structure, it is possible to cause the movable window panel to tilt and slide reliably.

In a preferred embodiment of the present invention, the stay and the guide rail are aligned in a vertical direction as viewed in the direction along the guide rail, and the guide rail has a receiving portion formed therein to receive the stay when the movable window panel is positioned at a fully closed position or in a vicinity of the fully closed position. Such a structure allows the stay to have a large size, thereby enabling the tilting movement of the movable window panel to be performed in a wide range.

Preferably, the openable roof window further includes a second sliding member configured to be slidable along the guide rail, wherein: the movable window panel has one end connected to the second sliding member so as to be pivotable about an axis extending in a direction intersecting the direction along the guide rail; and the shape of the cam groove in the stay is defined so as to cause the movable window panel to pivot about the axis to tilt up as the first sliding member is caused to slide together with the pin in the opening direction in a state where the lock member is at the lock position. This provides a simplified structure that enables the movable window panel to slide along the guide rail when the lock member is at the unlock position, while enabling the movable window panel to be tiltable in response to sliding of the first sliding member when the lock member is at the lock position.

Further preferably, the lock member is coupled to the second sliding member so as to be unmovable relative to each other in the direction along the guide rail, and is configured to engage the guide rail so as to be unmovable relative to the guide rail in the direction along the guide rail when the lock member is placed at the lock position and to be disengaged from the guide rail so as to be movable relative to the guide rail when the lock member is placed at the unlock position. This allows the lock member to selectively prevent sliding of the movable window panel along the guide rail in a simple and reliable structure.

Further preferably, the engagement structure engages the pin of the first sliding member with at least one of the lock member and the stay so as to be unmovable relative to each other in the direction along the guide rail when the lock member is at the unlock position. This ensures a reliable engagement between the first sliding member and the movable window panel by the engagement structure when the movable window panel should slide together with the first sliding member.

Preferably, the lock member has a cam groove formed therein such that the cam groove formed in the lock member engages the pin of the first sliding member to move the lock member between the lock position and the unlock position as the first sliding member moves relative to the lock member in the direction along the guide member. This provides a simple and reliable structure that allows the lock member to be selectively moved, in response to sliding of the first sliding member, between the lock position and the unlock position to selectively prevent and permit sliding of the movable window panel along the guide rail.

According to an embodiment of the present invention, it is possible to provide an openable roof window including a movable window panel that is tiltable and slidable, such that the support stiffness and the strength of the movable window panel are improved.

BRIEF DESCRIPTION OF THE DRAWINGS

Now the present invention is described in the following in terms of preferred embodiments thereof with reference to the appended drawings, in which.

DETAILED DESCRIPTION OF THE PREFERRED EMBODIMENTS

Figure 1:
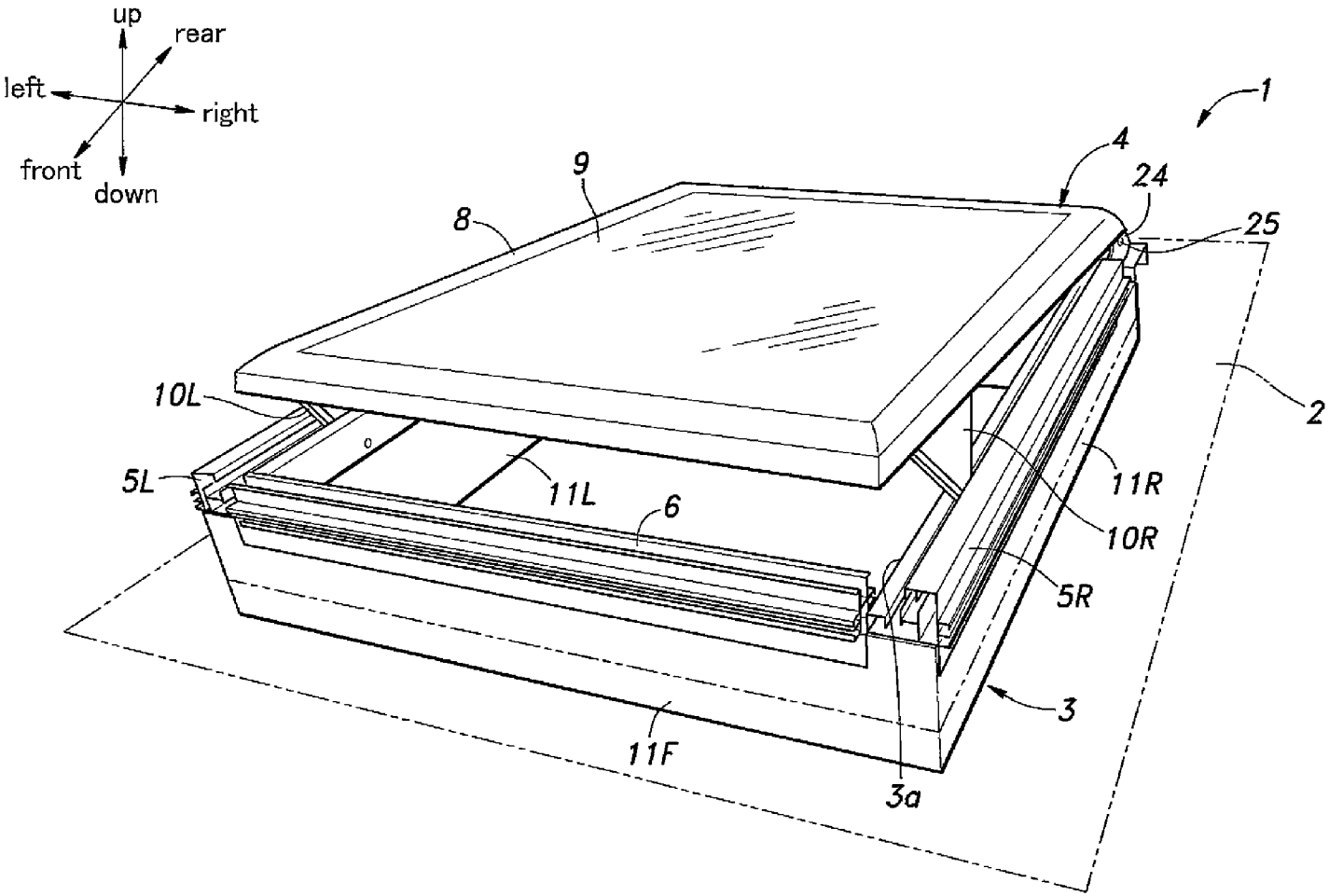
FIG. 1 is a schematic perspective view showing an openable roof window according to an embodiment of the present invention in a tilt-up state.

Now, with reference to the appended drawings, description will be made of an embodiment of the present invention, in which an openable roof window (simply referred to as a roof window 1 hereinafter) is mounted to a roof 2 of a house. It is to be noted that some component parts or portions such as those provided in a pair on left and right sides of the roof window, on front and rear (or back) sides of the roof window, or on inner and outer sides of a certain component part, will be denoted by reference signs including a common numeral suffixed with letters, such as "L" and "R" indicating "left" and "right," respectively, "F" and "B" indicating "front" and "back," respectively, or "i" and "o" indicating "inner" and "outer," respectively. For example, a pair of guide rails provided on either side of the roof window will be denoted by reference signs 5L (left guide rail) and 5R (right guide rail), respectively, and a pair of inner and outer slider guide grooves formed in each guide rail will be denoted by reference numerals 31*i* and 31*o*, respectively.

When there is no need to distinguish between the left and right guide rails 5R and 5L or between the inner and outer slider guide grooves 31*i* and 31*o*, for example, they may be simply referred to as the guide rails 5 or the slider guide grooves 31, respectively.

Figure 2:
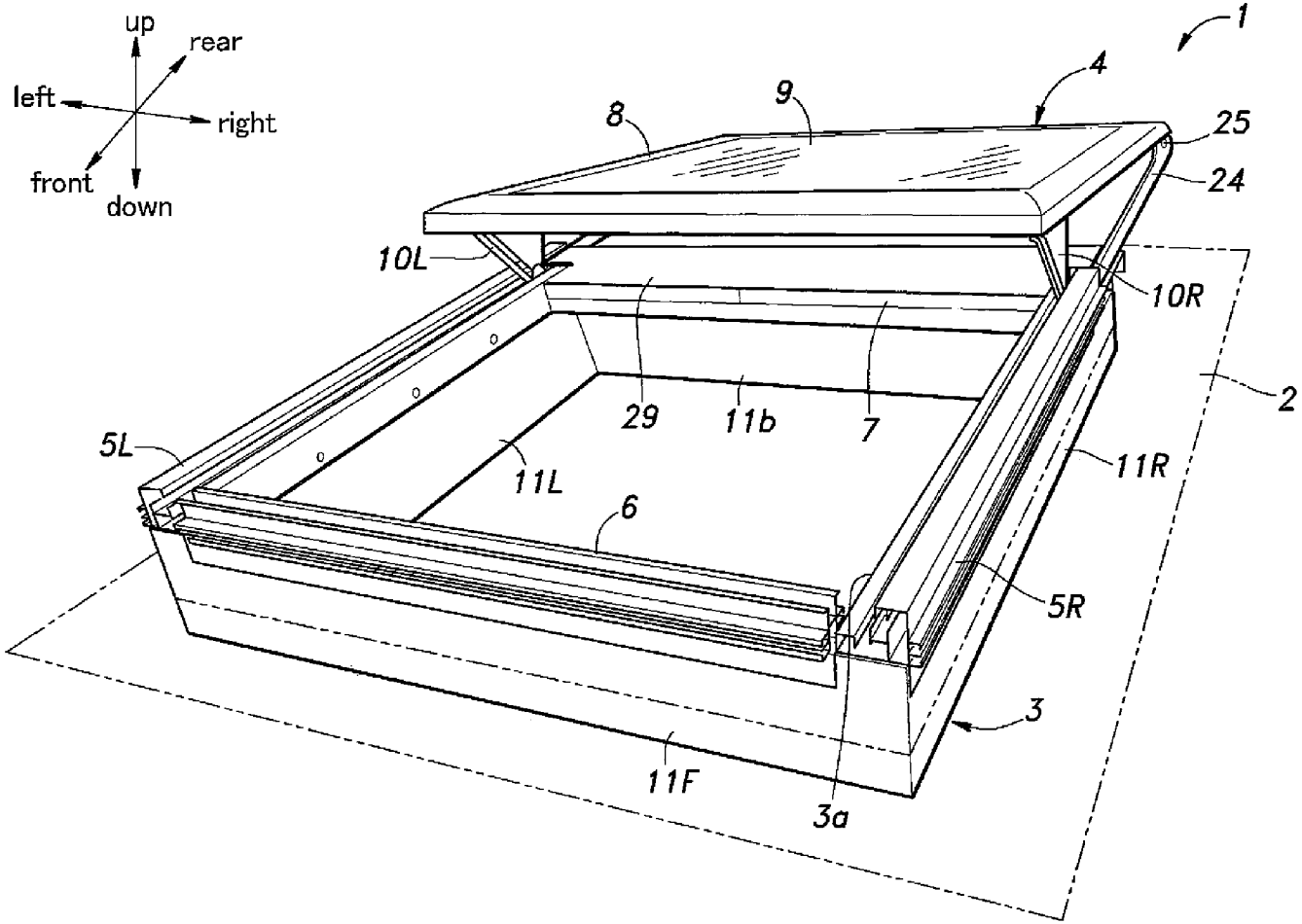
FIG. 2 is a schematic perspective view showing the openable roof window in a fully open state.

With reference to FIGS. 1 and 2, the roof window 1 includes a base frame 3 fixedly mounted to an inclined roof 2 so as to extend in parallel with the roof 2 and to project from the roof 2, and a movable window panel 4 for opening and closing an opening 3*a* defined by the base frame 3. FIG. 1 shows the roof window 1 in a tilt-up state in which the movable window panel 4 has finished moving from a fully closed position where the movable window panel 4 fully closes the opening 3*a* to a fully tilt-up position where a lower part of the movable window panel 4 has been lifted fully such that the movable window panel 4 is tilted relative to the base frame 3. The tilt-up state is a state just before the movable window panel 4 starts sliding movement. FIG. 2 shows the roof window 1 in a fully open state in which the movable window panel 4 has finished rearward (upward) sliding movement to a fully open position where the movable window panel 4 reveals the opening 3*a*. During the sliding movement of the movable window panel 4, the tilted state of the movable window panel 4 relative to the base frame 3 is maintained.

It is to be noted that in this description, the direction of sliding movement of the movable window panel 4 to close the opening 3*a* may be referred to as a forward direction, the direction of sliding movement of the same to expose the opening 3*a* may be referred to as a rearward direction, and the lateral directions relative to the sliding direction may be referred to as left and right directions. Thus, in this embodiment, the forward direction is a closing direction and the rearward direction is an opening direction. Further, it is assumed that an upward and downward direction coincides with a vertical direction, though in a description of a component part provided so as to extend in parallel with the inclined roof 2, "upper" may be used to indicate a side of the component part facing away from the roof 2 for the sake of convenience of explanation.

As shown in FIG. 2, the rear end of the movable window panel 4 is connected to a slide bar 24, which is configured to be slidable in the fore-and-aft direction as described later, via a connection pin 25 such that the movable window panel 4 is pivotable about the connection pin 25 to tilt (or change an angle) relative to the base frame 3. The slide bar 24 supports the weight of the rear portion of the movable window panel 4.

Figure 3:
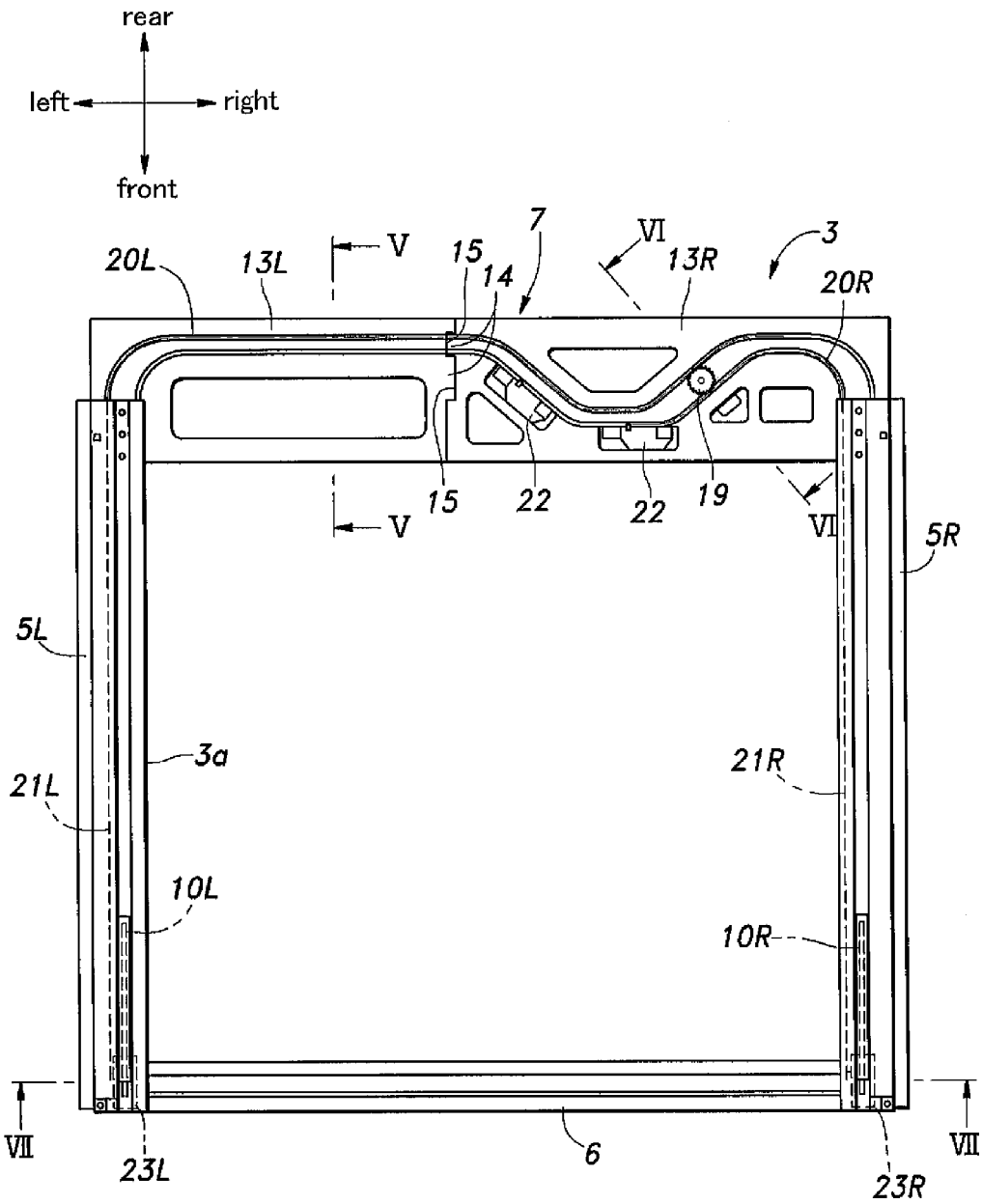
FIG. 3 is a plan view of a base frame shown in FIG. 1.

FIG. 3 is a plan view showing the base frame 3 as viewed in a direction perpendicular to the roof 2, with a later-described cover member 29 being removed. The base frame 3 as viewed in the plan view has a rectangular shape, and defines a rectangular opening 3*a* therein. A pair of guide rails 5L and 5R are mounted to an upper side (a side facing away from the roof 2) of either lateral peripheral portion of the base frame 3 such that the guide rails 5L and 5R extend along the left and right edges of the opening 3*a*, respectively, in parallel with each other. Further, a front frame 6 and a rear frame 7 are mounted to the upper side of a front part and a rear part of the base frame 3, respectively, such that the front frame 6 and the rear frame 7 extend along the front and rear edges of the opening 3*a*, respectively, in parallel with each other.

On the other hand, the movable window panel 4 includes a window frame 8 having a rectangular shape in correspondence with the shape of the base frame 3 and a transparent or translucent windowpane member 9 supported by the window frame 8, as shown in FIGS. 1 and 2. A pair of stays 10L and 10R each having a substantially triangular shape are secured to the window frame 8 in the vicinity of the front end of the window frame 8 on either lateral side, such that each of the stays 10L and 10R protrudes toward a vehicle compartment and extends in the fore-and-aft direction. Each stay 10 is formed of a metallic plate-shaped member having a high rigidity and having a relatively large size in the fore-and-aft direction as compared to a rod-shaped stay, thereby improving the strength of the window frame 8.

Figure 5:
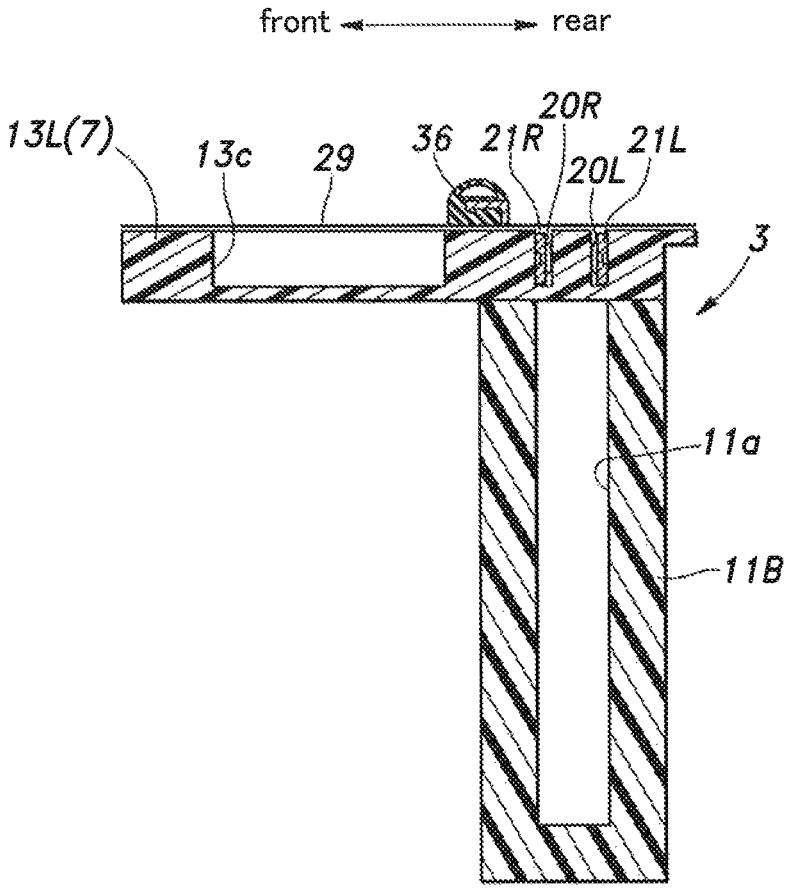
FIG. 5 is a cross-sectional view taken along line V-V in FIG. 3.
Figure 6:
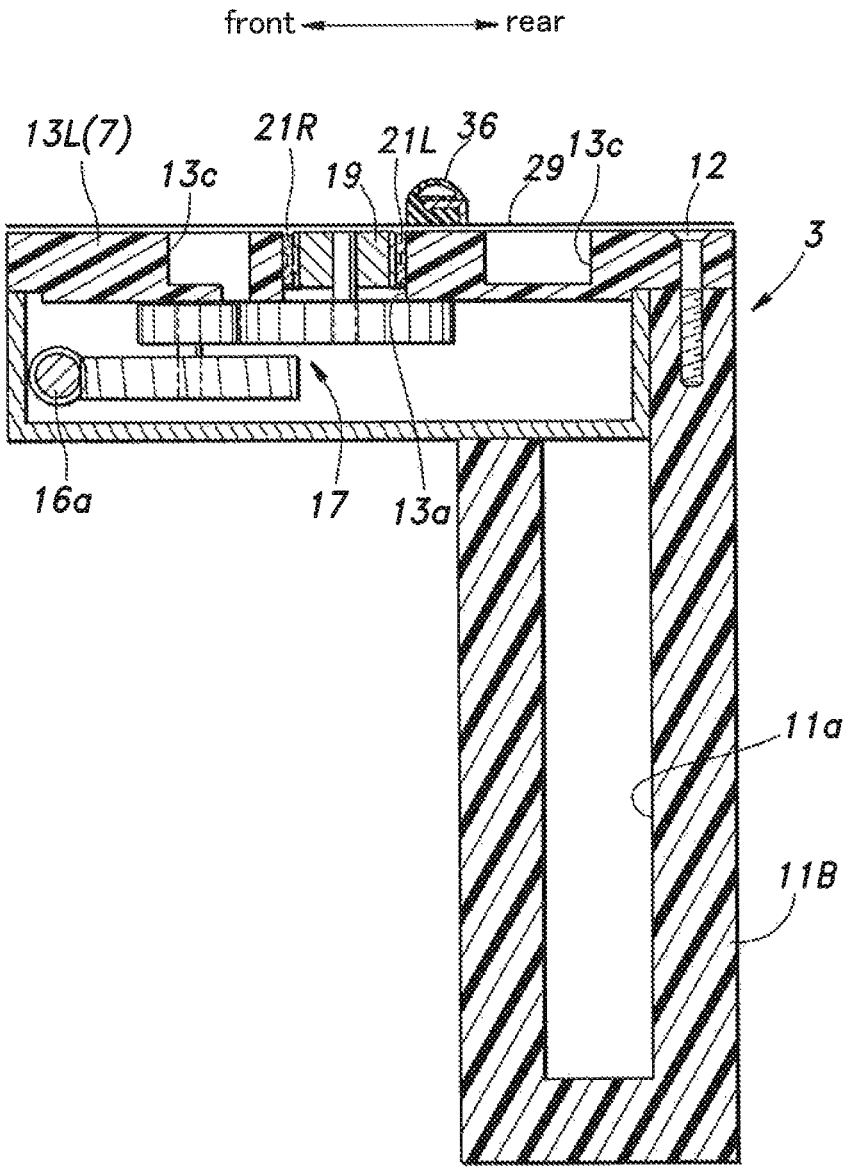
FIG. 6 is a cross-sectional view taken along line VI-VI in FIG. 3.
Figure 7:
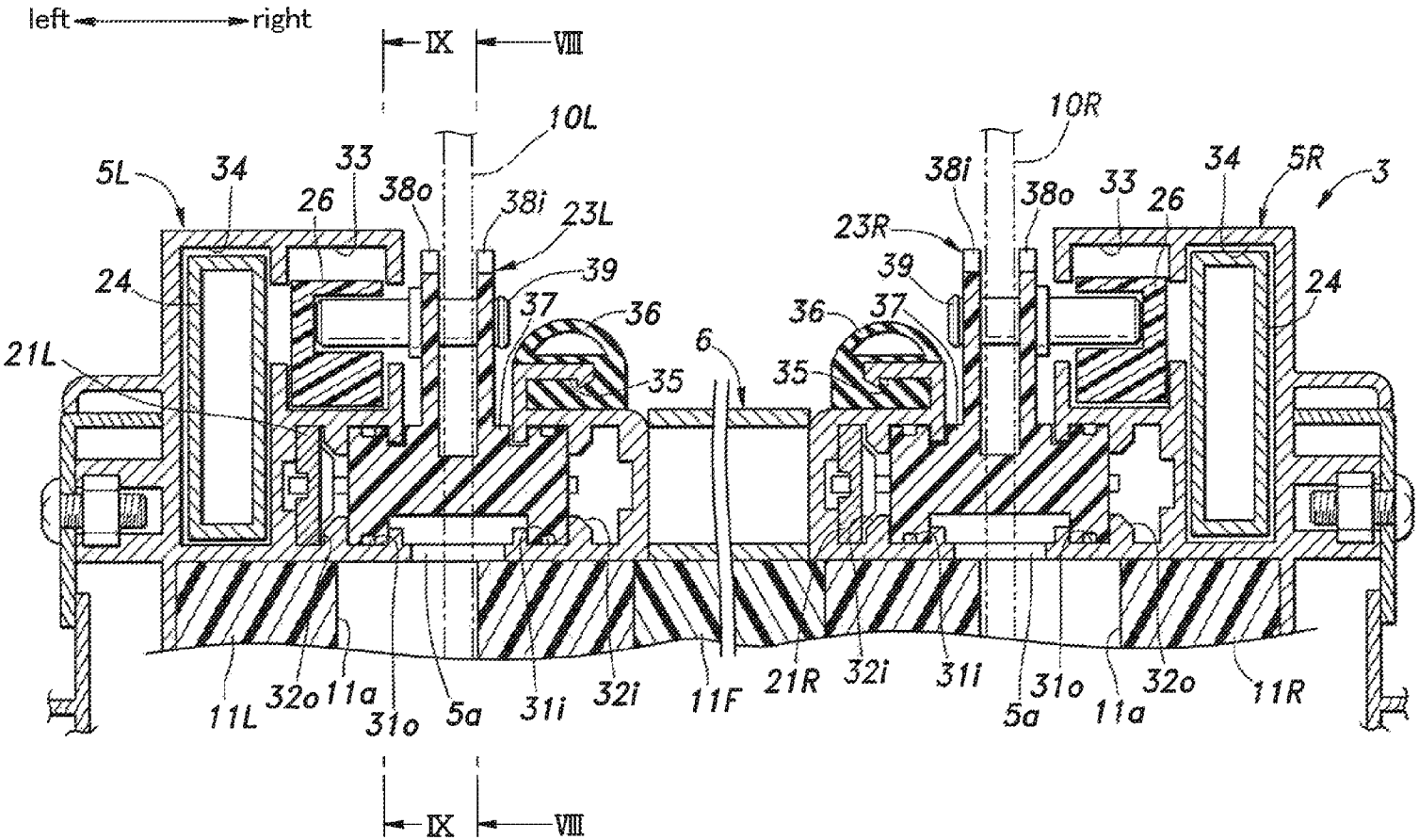
FIG. 7 is a cross-sectional view taken along line VII-VII in FIG. 3.

As shown in FIGS. 5 to 7, the base frame 3 is formed of frame members 11 (11L, 11R, 11F, 11B) attached together in a rectangular shape, where each frame member 11 consists of an elongated member extending straight and having an upward opening groove 11*a* formed therein such that each frame member 11 has a U-shaped cross section. In the illustrated embodiment, each frame member 11 is made of a synthetic resin, though each frame member 11 may be made of wood.

Figure 4:
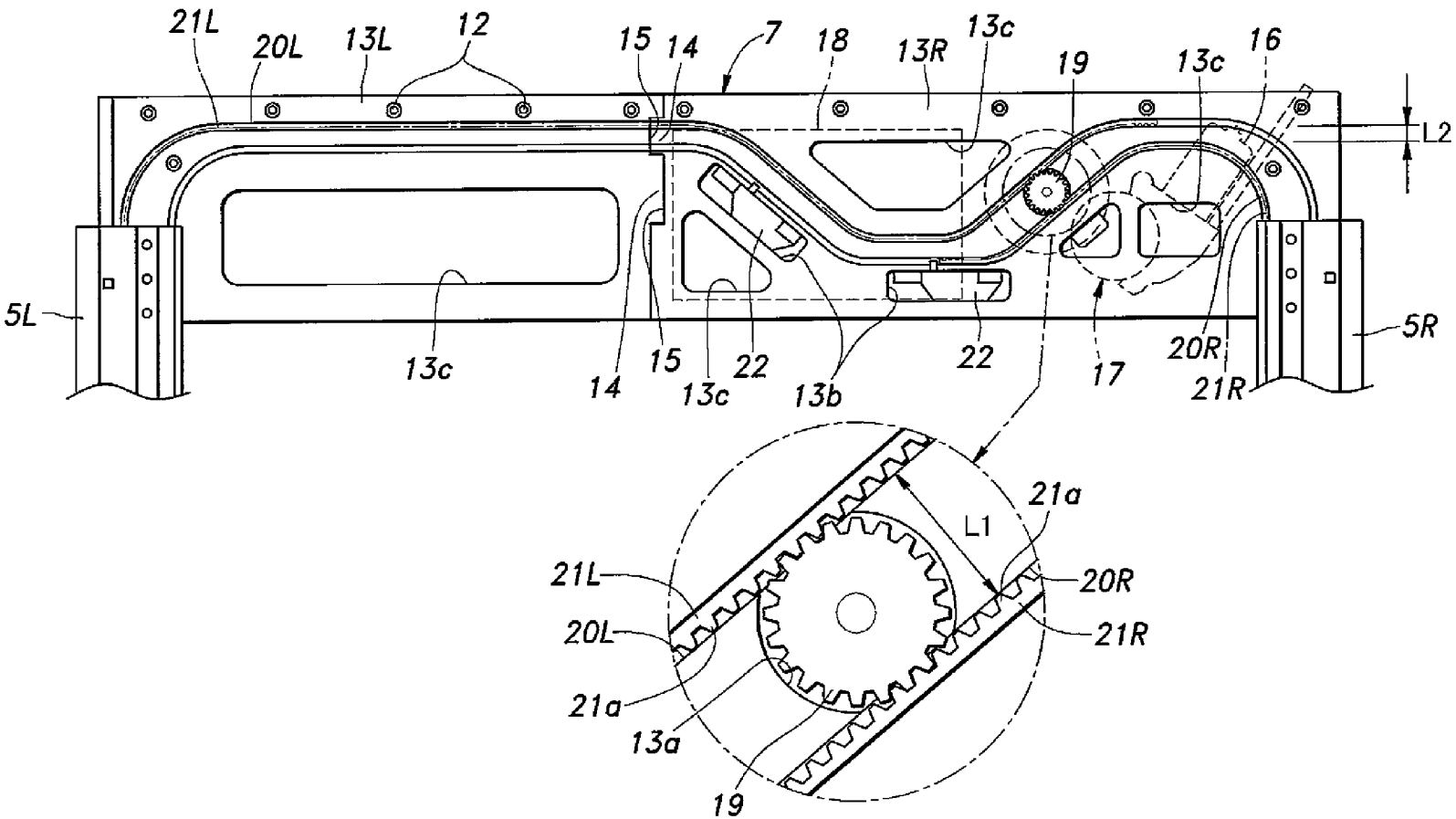
FIG. 4 is a fragmentary enlarged view of a rear frame shown in FIG. 3.

As shown in FIGS. 4 and 6, the rear frame 7 is fastened to the rear frame member 11B by means of screws 12. Further, as shown in FIGS. 3 and 4, the rear frame 7 is formed by joining left and right plate-shaped members 13L and 13R to each other, and is connected to the rear ends of the guide rails 5L and 5R. The plate-shaped members 13L and 13R have convex portions 14 and concave portions 15 formed in the mutually opposing joint faces thereof, such that the convex portions 14 are fitted in the concave portions 15 to prevent relative movement between the plate-shaped members 13L and 13R in the fore-and-aft direction when the plate-shaped members 13L and 13R are mounted to the base frame 3. Each plate-shaped member 13L, 13R is formed by injection molding a resin material.

As shown by broken lines in FIG. 4, mounted to the underside of the right plate-shaped member 13R of the rear frame 7 are an electric motor 16 for driving the movable window panel 4, a transmission mechanism 17 which engages with a worm gear 16*a* (see FIG. 6) provided on the output shaft of the electric motor 16 and serves as a power transmission mechanism for transmitting a driving force from the electric motor 16, and a control board 18 for controlling the electric motor 16. The control board 18 may include a driver for driving the electric motor 16 and an optical remote control receiver for receiving a control signal from a remote controller not shown in the drawings.

As shown in FIGS. 4 and 6, a through-hole 13*a* is formed substantially at a center of the right plate-shaped member 13R in the fore-and-aft direction, and a pinion gear 19 provided on the output shaft of the transmission mechanism 17 is received in the through-hole 13*a*. The pinion gear 19 serves as a drive gear for pushing and pulling later-described rack belts 21, and is disposed such that an axis thereof extends perpendicularly to the principal surface of the right plate-shaped member 13R.

As shown in FIGS. 4, 5 and 6, an upper surface of the rear frame 7 has a pair of guide grooves 20 (20L, 20R) formed therein. It is to be noted that the upper surface refers to a surface facing away from the roof 2, and this applies to the following description. The guide grooves 20 formed in the upper surface of the rear frame 7 generally extend in the lateral direction and are connected to the front and rear parts of the through-hole 13*a*, respectively. The guide grooves 20 include a left guide groove 20L for guiding a left rack belt 21L connected to a left slider 23L (FIG. 3) adapted to slide along the left guide rail 5L and a right guide groove 20R for guiding a right rack belt 21R connected to a right slider 23R (FIG. 3) adapted to slide along the right guide rail 5R. In the illustrated embodiment, the left guide groove 20L extends on a rear side of the pinion gear 19 while the right guide groove 20R extends on a front side of the pinion gear 19.

As shown in FIG. 4, each of the guide grooves 20L and 20R extends from the rear end of the left guide rail 5L rearward and inward in a curved manner, and then, extends straight in the rightward direction along the rear edge of the rear frame 7 (left plate-shaped member 13L) until it reaches the right plate-shaped member 13R. Thereafter, each guide groove 20L, 20R extends in the right plate-shaped member 13R generally in the rightward direction while bulging forward, such that each guide groove 20L, 20R extends obliquely in the forward direction, straight in the rightward direction, obliquely in the rearward direction, and again straight in the rightward direction along the rear edge of the rear frame 7 (right plate-shaped member 13R). Then, each guide groove 20L, 20R is curved forward to extend to the rear end of the right guide rail 5R. The guide grooves 20L and 20R are formed so as not to cross each other, and the left guide groove 20L is positioned on an outer side of the right guide groove 20R both at the rear end of the left guide rail 5L and at the rear end of the right guide rail 5R.

A pair of rack belts 21L and 21R are received in the guide grooves 20L and 20R, respectively. Each rack belt 21L, 21R is provided with a driven gear 21*a* engaging the pinion gear 19. One end of the rack belt 21L is connected to the left slider 23L and one end of the rack belt 21R is connected to the right slider 23R, whereby the rack belts 21L and 21R serve as power transmission members for transmitting the driving force from the electric motor 16 to the sliders 23.

The left rack belt 21L connected to the left slider 23L is slidably received in the left guide groove 20L passing on the rear side of the pinion gear 19 in the rear frame 7, with the driven gear 21*a* of the left rack belt 21L facing forward. On the other hand, the right rack belt 21R connected to the right slider 23R is slidably received in the right guide groove 20R passing on the front side of the pinion gear 19 in the rear frame 7, with the driven gear 21*a* of the right rack belt 21R facing rearward. It is to be noted that the curved sections of each guide groove 20 are designed to have as large a radius of curvature as possible, since a smaller radius of curvature tends to necessitate a larger force to drive the rack belts 21.

The aforementioned through-hole 13*a* is formed on one of the obliquely extending sections of the pair of guide grooves 20L and 20R forming the forward bulging portion. A distance L1 between the portions of the guide grooves 20L and 20R in contact with the through-hole 13*a* is designed to be larger than a distance L2 between the other portions of the guide grooves 20L and 20R excluding the portions near the guide rails 5L and 5R. This allows the pinion gear 19 to have a large diameter without increasing the size of the rear frame 7 in the fore-and-aft direction.

The upper surface of the right plate-shaped member 13R of the rear frame 7 has a pair of recesses 13*b* connected with the right guide groove 20R, which is positioned in front of the left guide groove 20L. A pair of sensors 22 are received in the respective recesses 13*b*, such that each sensor 22 turns on and off in response to presence/absence of the right rack belt 21R at the position where the recess 13*b* is connected with the right guide groove 20R. Specifically, the right one of the sensors 22 in FIG. 3 serves as a closed position sensor which is turned off in response to the absence of the right rack belt 21R to indicate that the movable window panel 4 has reached a fully closed position. On the other hand, the left one of the sensors 22 serves as a tilt position sensor which is turned on in response to the presence of the right rack belt 21R to indicate that the movable window panel 4 has reached a fully tilt-up position. Further, though not shown in the drawings, an open position sensor is provided to the right guide rail 5R, the open position sensor being turned on and off in response to presence/absence of the right slider 23R to indicate that the movable window panel 4 has reached a fully open position.

Further, the upper surface of the right plate-shaped member 13R of the rear frame 7 has multiple (in this embodiment, three) thinning recesses 13*c* formed therein such that the thinning recesses 13*c* are distributed at appropriate positions. On the other hand, the upper surface of the left plate-shaped member 13L of the rear frame 7 has one thinning recess 13*c* that is larger than those formed in the right plate-shaped member 13R. These thinning recesses 13*c* are formed so as not to extend to an edge of the plate-shaped members 13 as viewed in the plan view, thereby achieving both reduction in weight of the plate-shaped members 13 and prevention of reduction in strength of the plate-shaped members 13. Further, the thinning recesses 13*c* are formed so as not to extend to the joint faces of the plate-shaped members 13L and 13R, thereby preventing reduction in strength at the joint.

It is to be noted that a cover member 29 is mounted to the upper surface of the rear frame 7 to cover the entirety of the upper surface, so that the through-hole 13*a*, recesses 13*b*, thinning recesses 13*c* and guide grooves 20 are all covered by the cover member 29.

As shown in FIG. 7, the left and right guide rails 5L and 5R are constituted of a pair of members formed by extrusion of an aluminum alloy to have an identical cross section and arranged in such directions that they are left-right symmetric to each other. Each guide rail 5 defines a pair of inner and outer slider guide grooves 31*i* and 310 for guiding the slider 23, a pair of belt guide grooves 32*i* and 32*o* provided on the inner and outer sides of the pair of slider guide grooves 31, respectively, so as to be connected with the slider guide grooves 31, the inner and outer belt guide grooves 32*i* and 32*o* having shapes laterally symmetric to each other, a lock arm guide groove 33 formed above the outer slider guide groove 310 and the outer belt guide groove 32*o* to guide a later-described lock arm 26, and a slide bar guide groove 34 for guiding the slide bar 24, the slide bar guide groove 34 being formed in the outermost portion so as to be connected with the lock arm guide groove 33.

The inner and outer slider guide grooves 31*i* and 310 are formed so as to be spaced apart from each other in the lateral direction and have openings facing each other. Each guide rail 5 includes a bottom wall 5*a* connecting the walls defining the slider guide grooves 31*i* and 310 to each other to achieve a unified structure of the guide rail 5, though the guide rail 5 does not include an upper wall connecting the inner and outer slider guide grooves 31*i* and 310 to each other so that the space between the slider guide grooves 31*i* and 310 has an open top.

A holding groove 35 is formed above the inner slider guide groove 31*i* of each guide rail 5. This holding groove 35 holds a weather strip 36 for waterproofing the joint between the movable window panel 4 and the guide rail 5. It is to be noted that, though not shown in FIG. 3, the weather strip 36 is arranged to surround the opening 3*a* of the base frame 3.

Each slider 23 includes a plate-shaped sliding part 37 which is slidably received in the inner and outer slider guide grooves 31*i* and 310, a pair of inner and outer support walls 38*i* and 38*o* projecting upward from a laterally central portion of the sliding part 37, and a pin 39 supported by the pair of support walls 38*i* and 38*o*. The sliding part 37 is supported in any of upward, downward, leftward and rightward directions by the walls defining the inner and outer slider guide grooves 31*i* and 31*o*. The pin 39 extends not only between the pair of support walls 38*i* and 38*o*, but also extends outward from the outer support wall 38*o* to protrude into the lock arm guide groove 33.

Each slider 23 is connected with the corresponding stay 10 disposed between the pair of support walls 38*i* and 38*o* via the pin 39, and supports the weight of the frontal part of the movable window panel 4. Owing to the structure in which the slider 23 supported in the upward, downward, leftward and rightward directions directly supports the stay 10 fixedly secured to the movable window panel 4, the support stiffness of the movable window panel 4 is improved. Further, the structure in which the stay 10 is disposed between the pair of support walls 38*i* and 38*o* and supported by the pin 39 extending therethrough also contributes to improvement in the support stiffness of the movable window panel 4.

Each of the sliders 23L and 23R is connected to the corresponding one of the pair of rack belts 21L and 21R, and is caused to slide inside the slider guide grooves 31 in the fore-and-aft direction when the rack belts 21L and 21R are driven by the pinion gear 19 in synchronization. It is to be noted here that in the left guide rail 5L, the left rack belt 21L connected to the left slider 23L is slidably received in the outer belt guide groove 32*o*, while in the right guide rail 5R, the right rack belt 21R connected to the right slider 23R is slidably received in the inner belt guide groove 32*i*. Namely, the rack belts 21 are arranged laterally asymmetrically.

Though the rack belts 21 are arranged asymmetrically in the left and right guide rails 5L and 5R, the guide rails 5L and 5R can be constituted of a pair of members having an identical cross section and arranged in such directions that they are left-right symmetric to each other, since the cross section defines the symmetrically-shaped inner and outer belt guide grooves 32*i* and 32*o* configured to be disposed on either lateral side of the slider 23. This contributes to minimizing the component cost.

Figure 8:
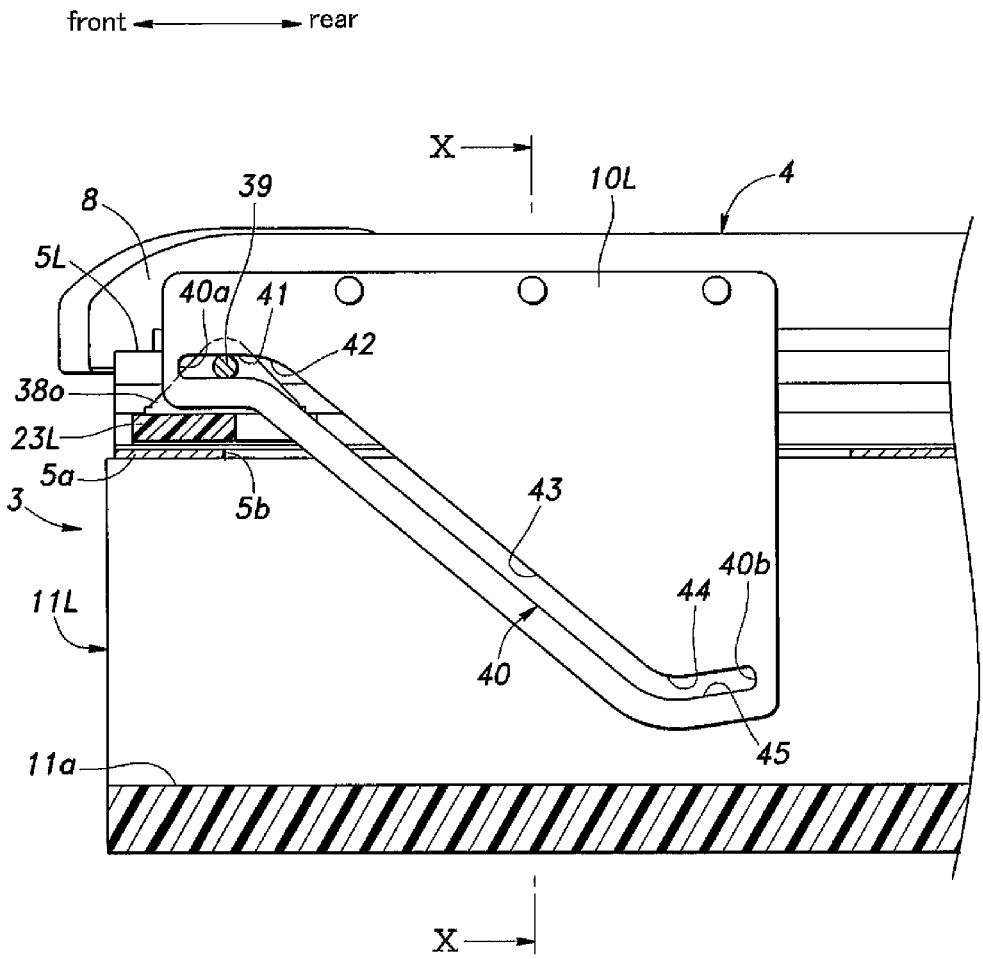
FIG. 8 is a cross-sectional view taken along line VIII-VIII in FIG. 7.

As shown in FIG. 8, each stay 10 fixedly secured to the window frame 8 of the movable window panel 4 has a tilt cam groove 40 formed therein, the tilt cam groove 40 generally extending along a front edge of the stay 10 which is inclined relative to the window frame 8. Each stay 10 is connected to the corresponding slider 23 through an engagement between the tilt cam groove 40 and the pin 39. In the state shown in FIG. 8 where the movable window panel 4 closes the opening 3*a*, the tilt cam groove 40 extends from a front end 40*a* thereof rearward in parallel with the base frame 3, then curves downward to extend straight obliquely in a rearward and downward direction, and thereafter curves upward to extend obliquely in a rearward and upward direction relative to the base frame 3 until it reaches a rear end 40*b*. In this description, the section extending rearward from the front end 40*a* is referred to as a first linear section 41, the curved section following the first linear section 41 is referred to as a first curved section 42, the section extending obliquely in a rearward and downward direction is referred to as an oblique section 43, the curved section following the oblique section 43 is referred to as a second curved section 44, and the section extending obliquely in a rearward and upward direction is referred to as a second linear section 45.

As shown in FIG. 8, an upper end portion of each stay 10 that is fixedly secured to the window frame 8 of the movable window panel 4 preferably has a dimension in the fore-and-aft direction (i.e., in the direction along the guide rail 5) substantially equal to or larger than the fore-and-aft dimension of the tilt cam groove 40. Thus, in this embodiment, each stay 10 has a relatively large fore-and-aft dimension, and this effectively improves the support stiffness and the strength of the movable window panel 4.

Figure 10:
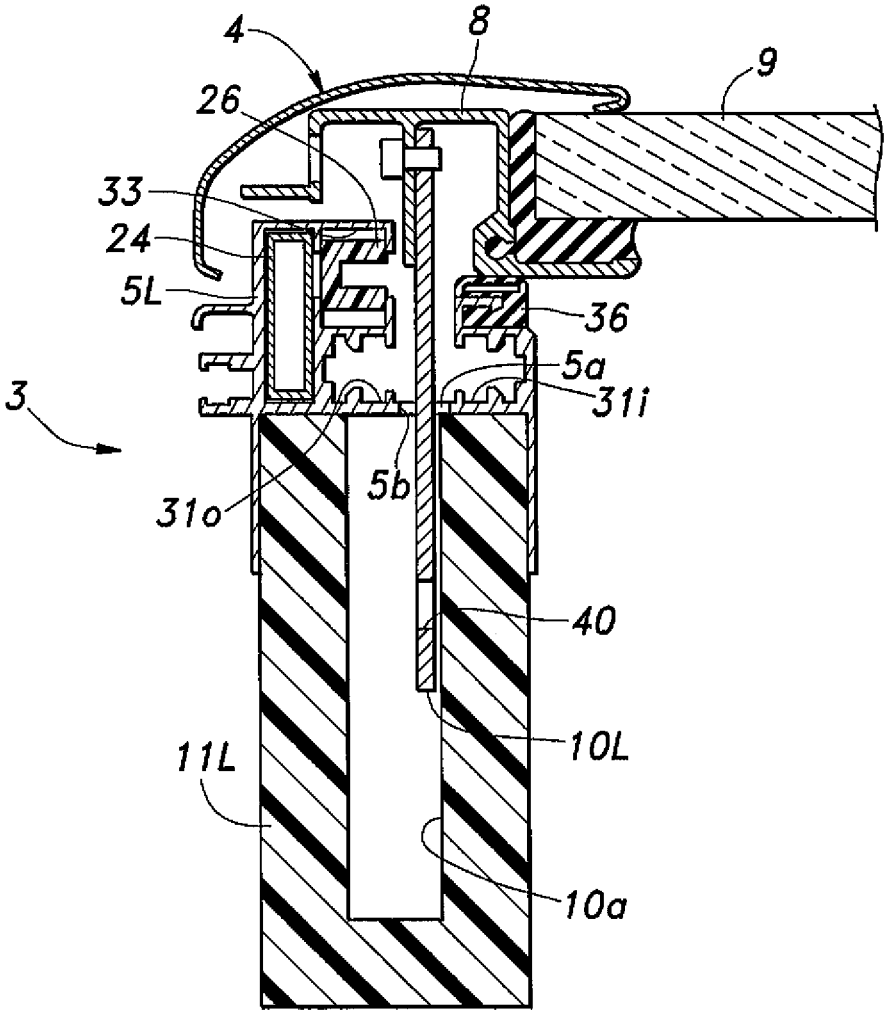
FIG. 10 is a cross-sectional view taken along line X-X in FIG. 8.

As shown in FIGS. 8 and 10, each of the left and right guide rails 5L and 5R has a slit 5*b* formed in the part of the bottom wall 5*a* between the inner and outer slider guide grooves 31*i* and 310 such that the slit 5*b* receives the stay 10 when the movable window panel 4 is at the fully closed position. The base frame 3 includes a frame member 11 with a groove 11*a* opening below the slit 5*b*, and the stay 10 is received in the slit 5*b* of the guide rail 5 and the groove 11 a of the base frame 3 (frame member 11) in the closed state. Such a structure allows the stay 10 mounted to the movable window panel 4 to have a large vertical size, thereby enabling the later-described tilting movement of the movable window panel 4 to be performed in a wide range.

Figure 9:
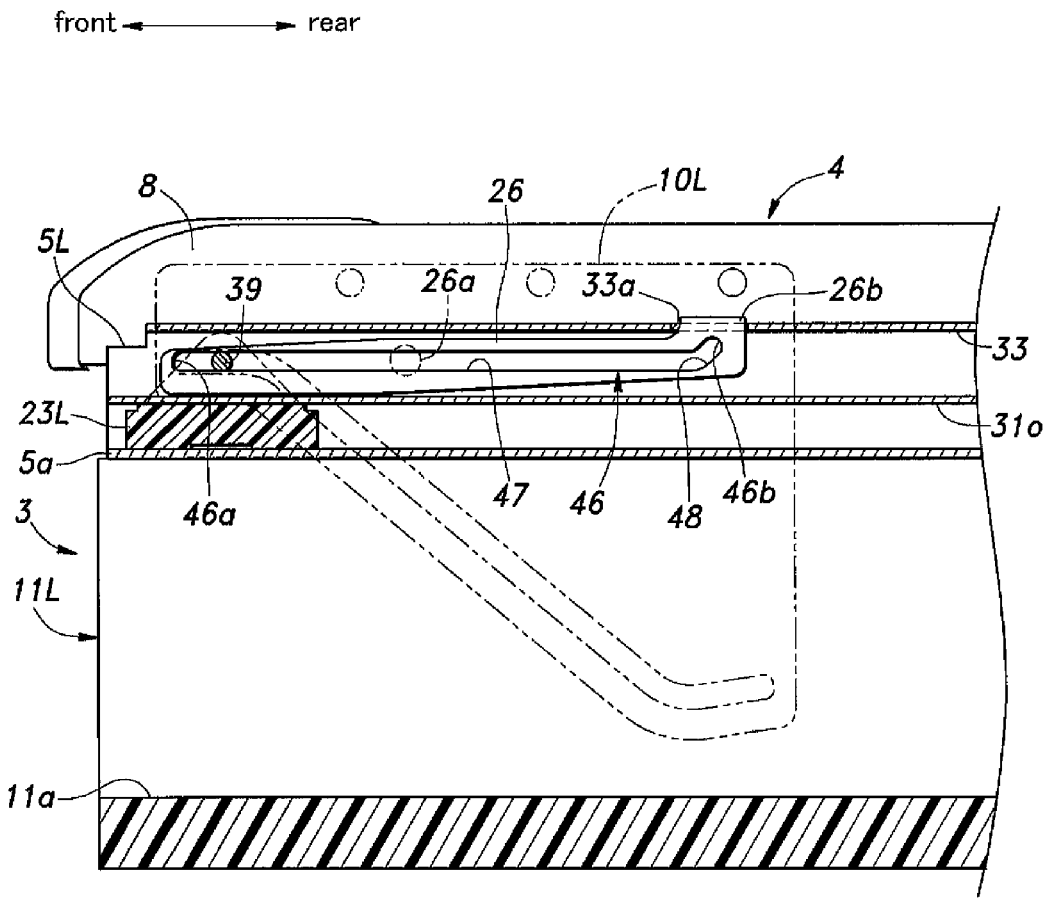
FIG. 9 is a cross-sectional view taken along line IX-IX in FIG. 7.

As shown in FIGS. 9 and 10, a lock arm 26 is slidably received in the lock arm guide groove 33. The lock arm 26 is supported by the slide bar 24 so as to be pivotable about a support axis 26*a*, and is slidable in the fore-and-aft direction together with the slide bar 24, namely, together with the movable window panel 4. The lock arm 26 has an engagement claw 26*b* at the rear end thereof such that the engagement claw 26*b* protrudes upward. In the state shown in FIG. 9 in which the movable window panel 4 is at the fully closed position, the engagement claw 26*b* enters into a cutout 33*a* formed in the upper wall of the lock arm guide groove 33.

The side of the lock arm 26 facing away from the slide bar 24 (namely, the inner side of the lock arm 26) is provided with a lock cam groove 46 extending in the fore-and-aft direction, and the protruding part of the pin 39 is slidably received in the lock cam groove 46. As shown in FIG. 9, in the state where the engagement claw 26*b* enters into the cutout 33*a*, the lock cam groove 46 extends rearward from its front end 46*a* in parallel with base frame 3, and curves upward to extend obliquely rearward and upward before reaching a rear end 46*b*. In this description, the section extending rearward from the front end 46*a* is referred to as a linear section 47, and the section extending obliquely rearward and upward is referred to as an oblique section 48.

Figure 11:
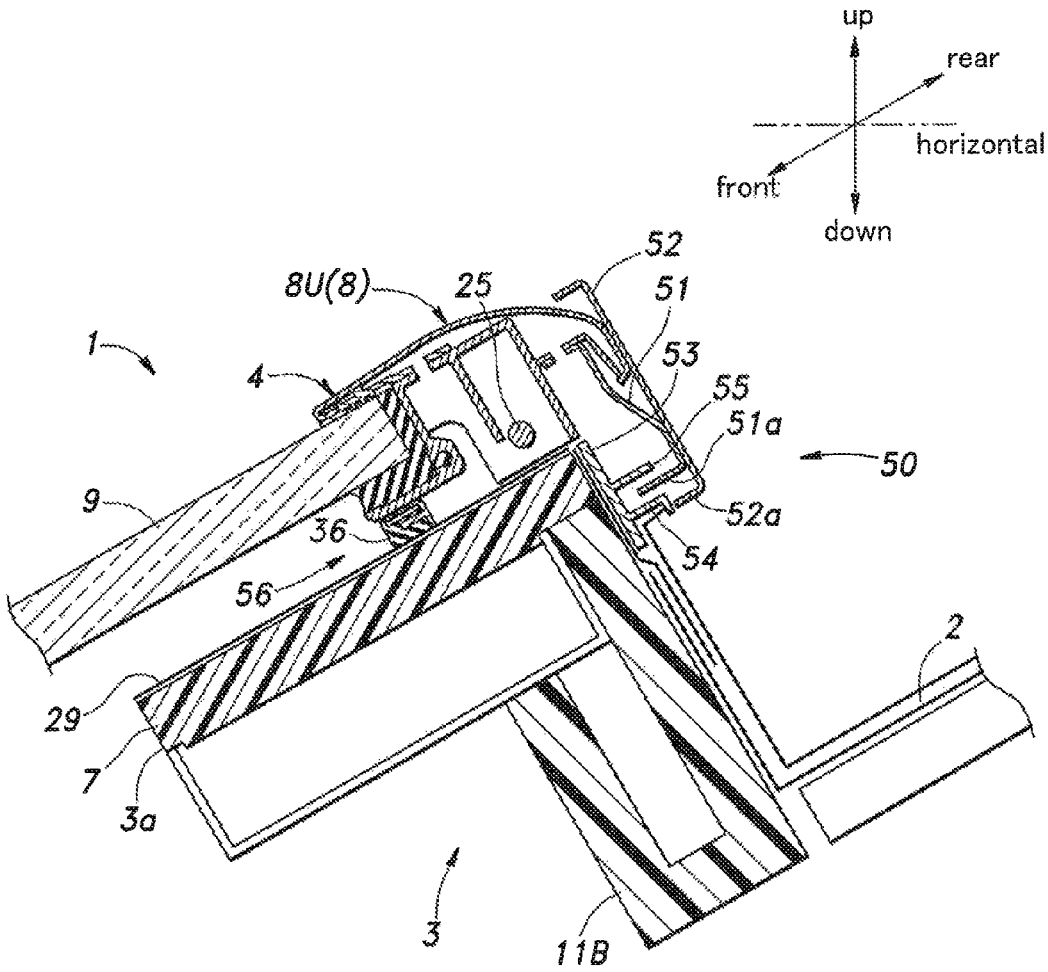
FIG. 11 is a cross-sectional view of a rear end portion of the openable roof window shown in FIG. 1.

FIG. 11 is a cross-sectional view of the rear end portion of the roof window 1 with the movable window panel 4 positioned at the fully closed position. The rear end portion of the roof window 1 is positioned higher than the other portions of the roof window 1 when the roof window 1 is installed on the roof 2, and thus, rainwater tends to enter through the rear end portion more easily than through the other portions. Therefore, the rear end portion of the roof window 1 is provided with a waterproofing structure as described below.

First, an outer cover member 52 is secured to an upper movable frame 8U forming a rear portion (i.e., a portion located at a higher position on the roof 2) of the window frame 8 of the movable window panel 4, such that the outer cover member 52 covers the base frame 3 from the rear side. The end portion of this outer cover member 52 close to the roof 2 is bent forward (i.e., toward the lower part of the roof 2) to form a second movable-side projection 52*a* that projects forward and extends over an entire length of the rear edge of the opening 3*a*. The second movable-side projection 52*a* is provided with such a projection length that the tip of the projection 52*a* is spaced apart from the base frame 3. Further, an inner cover member 51 is fixedly attached to an inner side of the outer cover member 52. The end portion of the inner cover member 51 close to the roof 2 is bent forward to form a first movable-side projection 51*a* that projects forward and extends over an entire length of the rear edge of the opening 3*a* at a position spaced apart from the roof 2 by a distance larger the distance by which the second movable-side projection 52*a* is spaced apart from the roof 2.

On the other hand, a waterproofing member 53 is attached to the rear frame 7 and the rear frame member 11B forming a rear portion (i.e., a portion located at a higher position on the roof 2) of the base frame 3, such that the water proofing member 53 extends along the upper edge of the rear surface of the rear frame 7. The rear surface of the waterproofing member 53 is provided with a pair of stationary-side projections 54 and 55, which project rearward and extend over an entire length of the rear edge of the opening 3*a* at positions spaced apart from the roof 2 by different distances, namely, at different positions in the direction perpendicular to the roof 2. The pair of stationary-side projections 54 and 55 are designed such that, in the state where the movable window panel 4 closes the opening 3*a*, the stationary-side projections 54 and 55 sandwich the first movable-side projection 51*a* therebetween, are respectively positioned spaced apart from the first movable-side projection 51*a* in the direction perpendicular to the roof 2, and have such a projection length that the stationary-side projections 54 and 55 sandwich (or overlap as viewed in the direction perpendicular to the roof 2) the tip-side half of the first movable-side projection 51*a*. Further, the stationary-side projection 54 is provided at such a position that the tip end of the stationary-side projection 54 opposes the tip end of the second movable-side projection 52*a*.

As described in the foregoing, the stationary-side projection 54 and the second movable-side projection 52*a* on the side close to the roof 2 are arranged such that the tip ends thereof oppose each other, and this prevents rainwater from entering and reaching a water-stopping part 56 provided between the under surface of the movable window panel 4 and the upper surface of the base frame 3. Further, since the pair of stationary-side projections 54, 55 and the first movable-side projection 51*a* form a labyrinth structure, intrusion of rainwater to the water-stopping part 56 is suppressed even more effectively.

Next, with reference to FIGS. 8, 9, 12 and 13, description will be made of an operation of the movable window panel 4. In the fully closed state shown in FIGS. 8 and 9, when the electric motor 16 is driven to move the pair of rack belts 21L and 21R via the transmission mechanism 17 such that the pair of sliders 23L and 23R slide rearward, the pin 39 of each slider 23L, 23R slides in the associated tilt cam groove 40 and lock cam groove 46. While the pin 39 is in the section in which both the cam grooves 40 and 46 extend in parallel with the base frame 3 (the first linear section 41 of the tilt cam groove 40), only the sliders 23 slide rearward and the movable window panel 4 and the lock arms 26 do not move.

With reference to FIG. 8, when the pin 39 of each slider 23 reaches the first curved section 42 of the tilt cam groove 40 after passing through the first linear section 41, the stays 10 begin to be lifted and the movable window panel 4 starts tilt-up movement. At this time, each stay 10 receives from the associated pin 39 a force that urges the movable window panel 4 rearward. However, since the engagement claw 26*b* of the lock arm 26 engages with the cutout 33*a* so that the lock arm 26 prevents sliding movement of the slide bar 24 (and hence the movable window panel 4), the movable window panel 4 undergoes only the tilt-up movement without sliding.

Figure 12:
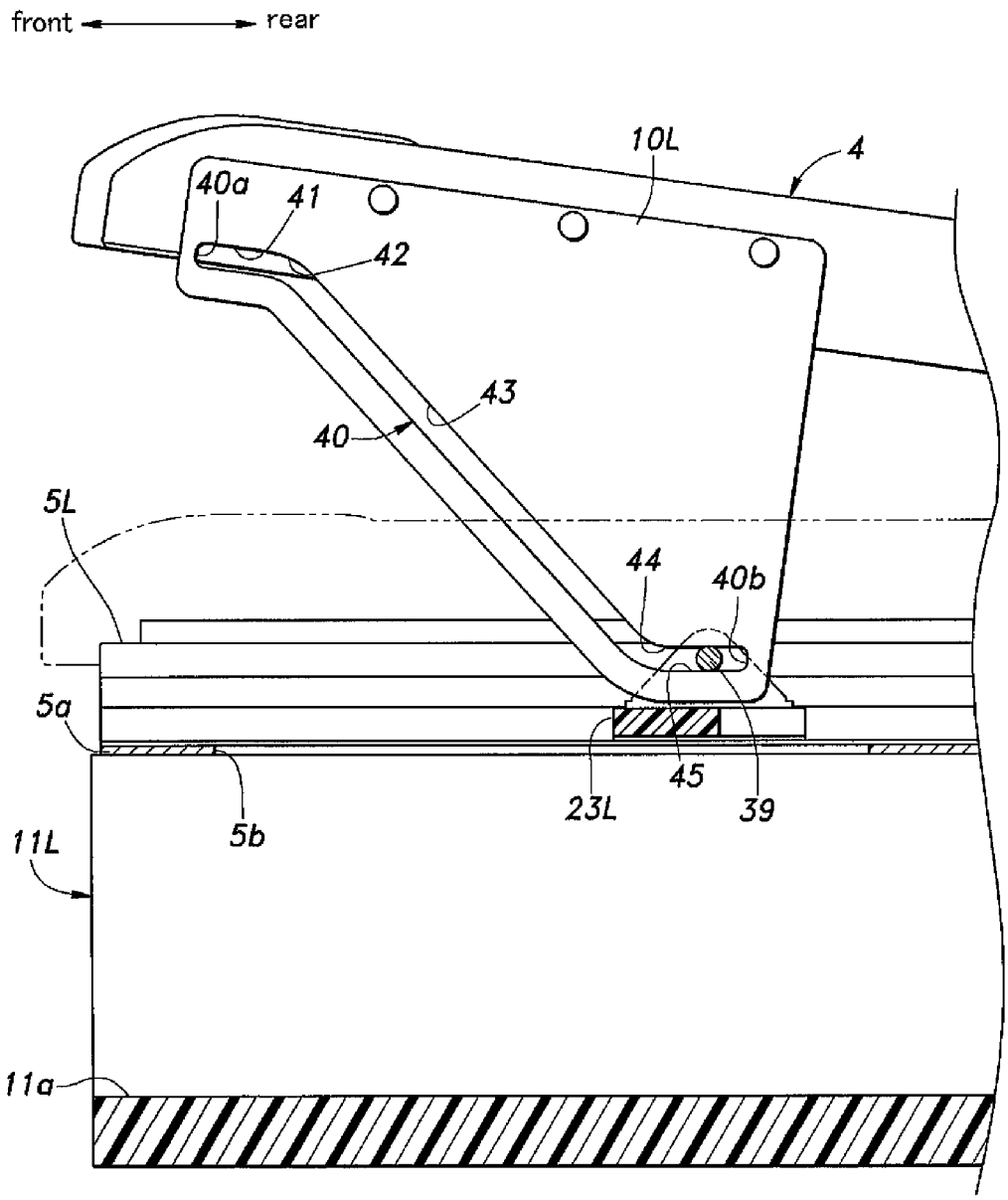
FIG. 12 is a view corresponding to FIG. 8 and showing a tilt-up state.

While the pin 39 of each slider 23 slides along the oblique section 43, the movable window panel 4 undergoes only the tilt-up movement, and when the pin 39 has passed the second curved section 44, the movable window panel 4 finishes the tilt-up movement and the lower end of the stay 10 is positioned higher than the bottom wall 5*a* of the guide rail 5, as shown in FIG. 12. Namely, the shape of the tilt cam groove 40 of each stay 10 is designed such that the movement of the slider 23 relative to the stay 10 causes the movable window panel 4 to undergo tilting movement. It is to be noted that when the movable window panel 4 is at the fully closed position or in the vicinity thereof (more specifically, between the fully closed position and a position before the fully tilt-up position), the stay 10 is received in the slit 5*b* formed in the guide rail 5.

With reference to FIG. 11, the pair of stationary-side projections 54 and 55 are provided at such elevations that the stationary-side projections 54 and 55 sandwich the first movable-side projection 51*a*, as described in the foregoing. However, since the first movable-side projection 51*a* is positioned so as to be spaced from each of the stationary-side projections 54 and 55 in the direction perpendicular to the roof 2 and the tip of the first movable-side projection 51*a* is spaced from the base frame 3, the first movable-side projection 51*a* is prevented from interfering with the stationary-side projections 54 and 55 when the movable window panel 4 undergoes tilting movement.

As shown in FIG. 12, in the state where the movable window panel 4 has finished the tilt-up movement, the second linear section 45 extends in parallel with the base frame 3. While the pin 39 of each slider 23 slides through the second linear section 45, the pin 39 enters the oblique section 48 of the lock cam groove 46 to cause the lock arm 26 to pivot downward, thereby releasing (or disengaging) the engagement claw 26*b* from the cutout 33*a*. Thereafter, the pin 39 engages with the rear end 46*b* of the lock cam groove 46 to cause the movable window panel 4 in the tilted state to slide rearward. Namely, the rear end 46*b* of the lock cam groove 46 and the pin 39 form an engagement structure for causing the slider 23 and the movable window panel 4 to slide unitarily in the rearward direction (opening direction) when the movable window panel 4 has reached the position where the tilt-up operation is finished.

It is to be noted that the pin 39 of each slider 23 may engage not only with the rear end 46*b* of the lock earn groove 46 but also with the rear end 40*b* of the tilt cam groove 40 or may engage with the rear end 40*b* of the tilt earn groove 40 instead of the rear end 46*b* of the lock cam groove 46, to cause the movable window panel 4 to slide rearward. In these cases, the engagement structure is formed by the pin 39 and the rear end 40*b* of the tilt cam groove 40 or by the pin 39 and both the rear end 40*b* of the tilt cam groove 40 and the rear end 46*b* of the lock cam groove 46.

The lock arm 26 is driven by the pin 39 such that, when the pin 39 is not in the rear end 40*b* of the tilt cam groove 40, the lock arm 26 is placed at a position where the lock arm 26 prevents sliding movement of the movable window panel 4 (a position where the engagement claw 26*b* projects into the cutout 33*a*), and when the pin 39 is in the rear end 40*b* of the tilt cam groove 40, the lock arm 26 is moved to a position where the lock arm 26 allows sliding movement of the movable window panel 4 (a position where the engagement claw 26*b* is disengaged from the cutout 33*a*).

When each slider 23 slides rearward together with the movable window panel 4 and reaches a predetermined fully open position near the rear end of the guide rail 5, the roof window 1 is brought into a fully open state shown in FIG. 2, in which the movable window panel 4 is placed at the fully open position. It is to be noted that the slide bar guide groove 34 of each guide rail 5 is provided with a stopper not shown in the drawings to prevent the slide bar 24 from moving rearward beyond the position corresponding to the fully open state.

Figure 13:
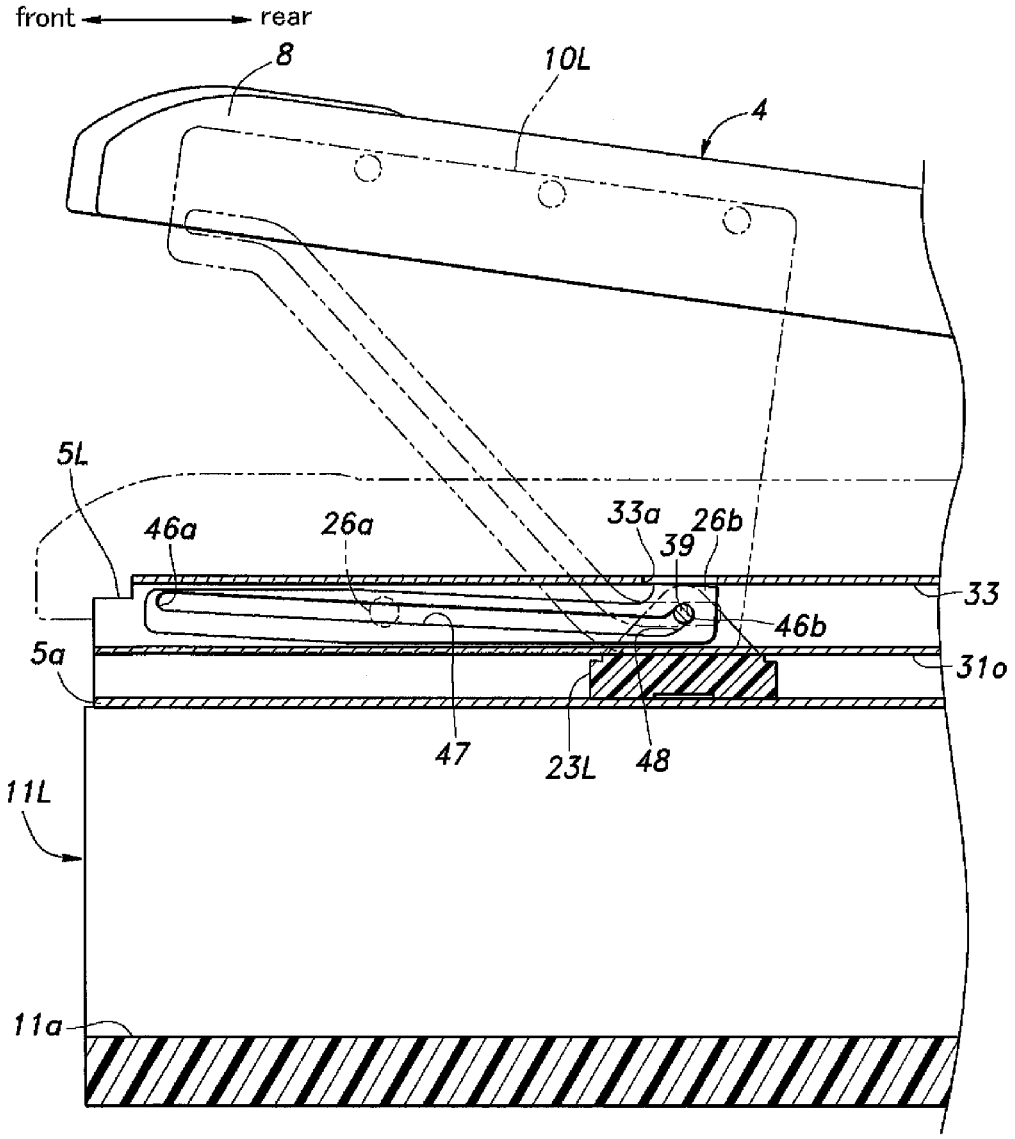
FIG. 13 is a view corresponding to FIG. 9 and showing a tilt-up state.

As shown in FIGS. 12 and 13, when the movable window panel 4 is between the fully tilt-up position and the fully open position, the second linear section 45 of the tilt cam groove 40 with which the pin 39 is engaged extends in parallel with the base frame 3 as described in the foregoing, and the pivoting of the lock arm 26 is restricted by the upper and lower walls of the lock arm guide groove 33 so that the lock arm 26 cannot move relative to the slider 23. In other words, the movable window panel 4 cannot move relative to the slider 23, and thus, the pin 39 is prevented from undesirably moving out of the second linear section 45 of the tilt cam groove 40 to tilt down the movable window panel 4.

The operation of the movable window panel 4 in the closing direction is the reverse of the operation in the opening direction described above. Thus, detailed explanation for the operation in the closing direction is omitted.

In the roof window 1 configured as described above, the control board 18 can control the electric motor 16 in response to an operation of a remote controller or a switch panel connected thereto by wire, to cause the movable window panel 4 to tilt or slide, selectively opening and closing the opening 3*a* in the base frame 3. In this embodiment, since the fully tilt-up position of the movable window panel 4 can be detected by the sensor 22 for detecting the tilt position, it is possible to set a tilt-up operation and a fully open operation as operations in the opening direction, for example.

Figure 14:
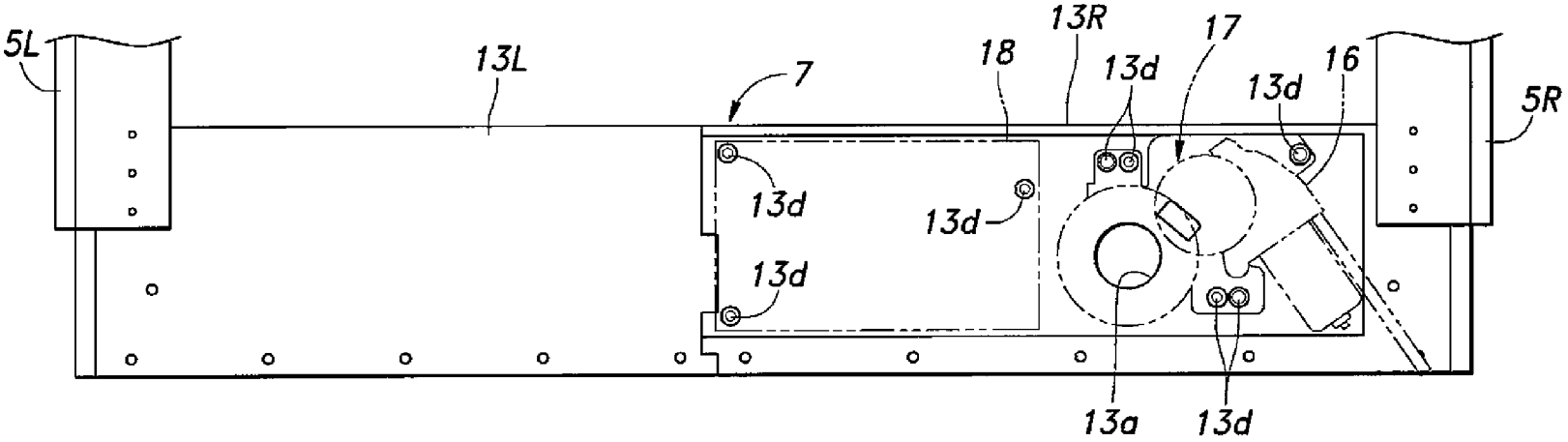
FIG. 14 is a bottom view of the rear frame shown in FIG. 3.

As described in the foregoing, the rear frame 7 (FIG. 4) is formed by joining together the left and right plate-shaped members 13L and 13R. The right plate-shaped member 13R is provided with the through-hole 13*a*, and the upper surface thereof has the recesses 13*b* formed therein to receive the two sensors 22. Further, since the electric motor 16, the transmission mechanism 17 and the control board 18 are mounted on the under surface of the right plate-shaped member 13R, multiple bosses 13*d* are formed on the under surface of the right plate-shaped member 13R, as shown in FIG. 14. Thus, a mold pattern for molding the right plate-shaped member 13R tends to be complex and expensive.

On the other hand, it may be desired to provide the roof window 1 in a variety of sizes to meet various user needs. If the rear frame 7 were molded as a single part, it would be required to prepare a complex and expensive mold pattern for each size, which would lead to a higher manufacturing cost. To address such a problem, in the present embodiment, the rear frame 7 is divided into the left and right members which are fabricated separately and joined together to form the rear frame 7.

Figure 15:
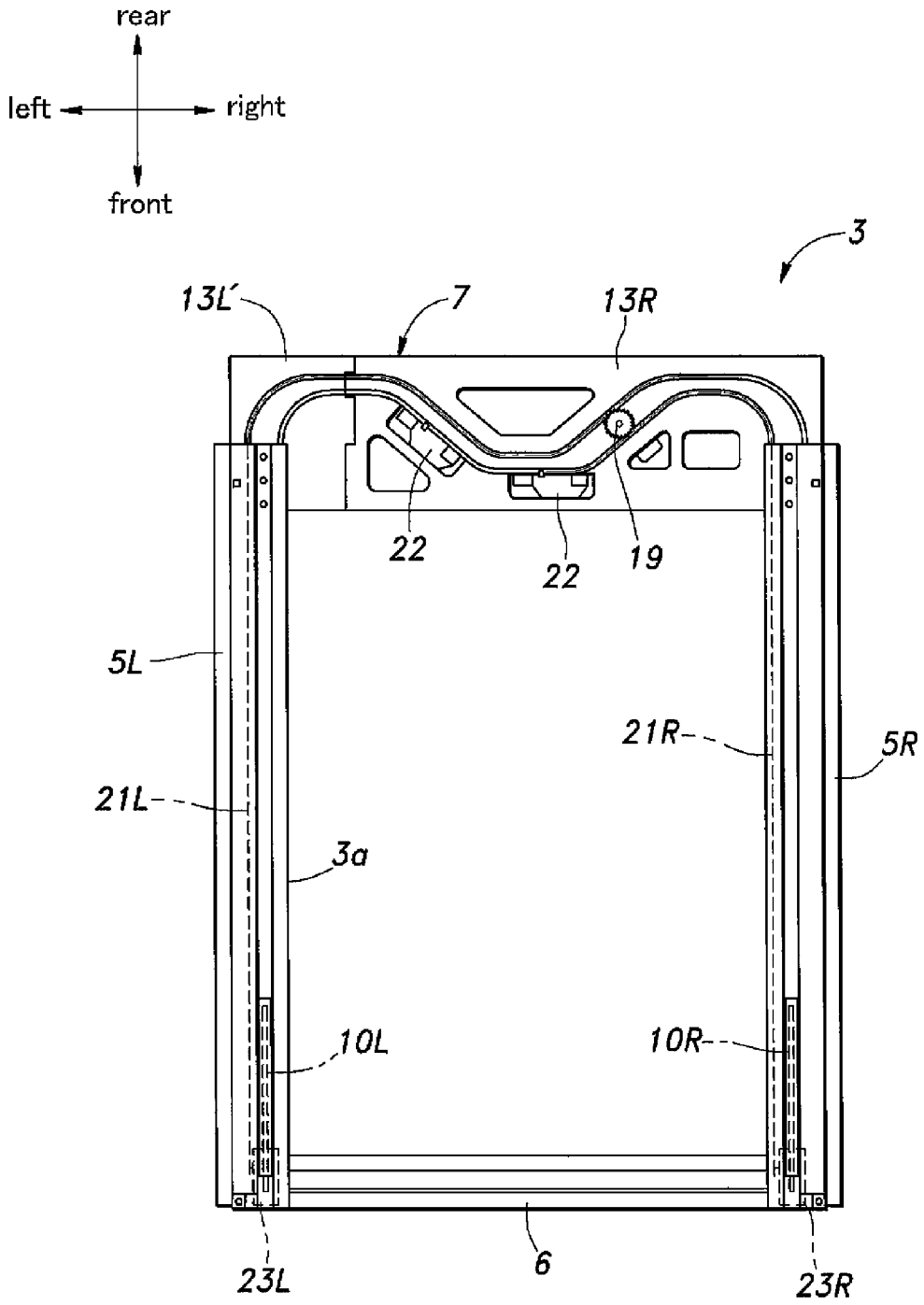
FIG. 15 is a plan view corresponding to FIG. 3 and showing a base frame to be used in an openable roof window having a relatively small width.

For example, in a case where a rear frame shorter in length than the rear frame 7 shown in FIG. 3 is to be fabricated, a left plate-shaped member 13L' shorter than the left plate-shaped member 13L shown in FIG. 3 is fabricated and joined to the commonly used right plate-shaped member 13R, as shown in FIG. 15. In this way, it is possible to fabricate the rear frame 7 in a variety of sizes at low cost by eliminating the need for preparing a plurality of complex and expensive mold patterns.

The right plate-shaped member 13R is provided with the two sensors 22 serving as a fully closed position sensor and a fully tilt-up position sensor, respectively. Therefore, it is desirable that, even when the size of the left plate-shaped member 13L and/or the size of the guide rails 5L and 5R are changed, the sensors 22 function properly without need for changing of the positions thereof. In the illustrated embodiment, since the sensors 22 are positioned and configured to detect the passage of the end portion of the right rack belt 21R extending out of the right guide rail 5R, the sensors 22 can function properly without changing their positions even when the size of the left plate-shaped member 13L and/or the size of the guide rails 5L and 5R are changed.

Although the present invention has been described in terms of preferred embodiments thereof, it is obvious to a person skilled in the art that various alterations and modifications are possible without departing from the scope of the present invention which is set forth in the appended claims. For example, though the rack belts are used as power transmission members in the foregoing embodiment, it is possible to use push-pull cables on which a driven gear is formed in a helical pattern. It is also to be noted that not all of the component parts of the roof window 1 shown in the illustrated embodiments are necessarily indispensable, and they may be selectively used as appropriate.

Further, a waterproofing structure may also be provided to the frontal end portion of the roof window 1. For example, the movable window panel 4 may include an overhanging portion covering the front face of the base frame 3 (the front frame 6) in the fully closed state to prevent intrusion of rainwater. In such a case, the tilting up of the frontal part of the movable window panel 4 allows the movable window panel 4 to slide rearward (upward) without the overhanging portion thereof interfering with the base frame 3 (or the front frame 6).

The contents of the original Japanese patent application (Japanese Patent Application No. 2012-144639 filed on Jun. 27, 2012) on which the Paris Convention priority claim is made for the present application as well as the contents of the prior art references mentioned in this application are incorporated in this application by reference.

The invention claimed is:

1. An openable roof window, comprising:

a base frame defining an opening and configured to be secured to a roof;

a guide rail mounted to the base frame;

a movable window panel configured to be slidable along the guide rail in an opening direction to open the opening and in a closing direction to close the opening, the movable window panel further configured to be tiltable relative to the base frame;

a first sliding member having a pin and configured to be driven by a drive device to slide along the guide rail;

a stay fixedly secured to the movable window panel and having a cam groove formed therein, the cam groove including a first end portion and a second end portion opposite the first end portion;

a lock member configured to be in a lock position where the lock member prevents sliding of the movable window panel along the guide rail when the pin is at a position in the cam groove other than the second end portion of the cam groove and configured to be moved to an unlock position where the lock member permits the sliding of the movable window panel along the guide rail when the pin is in the cam groove at the second end portion of the cam groove, the lock member having a lock cam groove formed therein such that the pin engages the lock cam groove to move the lock member between the lock position and the unlock position as the first sliding member moves relative to the lock member along the guide rail;

wherein the lock cam groove, the cam groove and the pin form an engagement structure that selectively engages the first sliding member with the movable window panel such that the first sliding member and the movable window panel are unmovable relative to each other in the opening direction along the guide rail when the lock member is in the unlock position, and wherein the engagement structure allows the first sliding member to move relative to the movable window panel in the opening direction along the guide rail when the lock member is in the lock position; and wherein the cam groove of the stay engages the pin of the first sliding member and has a shape defined such that, when the engagement structure does not engage the first sliding member with the movable window panel, the movable window panel is caused to tilt relative to the base frame as the first sliding member moves relative to the stay as a result of the first sliding member sliding along the guide rail.

2. The openable roof window according to claim 1, wherein the stay and the guide rail are aligned in a vertical direction as viewed in the opening direction along the guide rail, and the guide rail has a receiving portion formed therein to receive the stay when the movable window panel is positioned at a fully closed position or adjacent to the fully closed position.

3. The openable roof window according to claim 2, wherein the receiving portion of the guide rail includes a slit formed in a bottom wall of the guide rail.

4. The openable roof window according to claim 1, further comprising a second sliding member configured to be slidable along the guide rail, wherein:

the movable window panel has one end thereof connected to the second sliding member so as to be pivotable about an axis extending in a direction intersecting the Opening direction; and the shape of the cam groove in the stay is defined so as to cause the movable window panel to pivot about the axis and tilt up relative to the base frame as the first sliding member and the pin slide in the opening direction along the guide rail when the lock member is in the lock position.

5. The openable roof window according to claim 4, wherein the lock member is coupled to the second sliding member so as to be unmovable relative to each other in the opening direction along the guide rail, is configured to engage the guide rail so as to be unmovable relative to the guide rail in the opening direction along the guide rail when the lock member is in the lock position, and is configured to be disengaged from the guide rail so as to be movable relative to the guide rail when the lock member is moved to the unlock position.

* * * * *